United States Patent [19]

Walker

[11] 4,025,967

[45] May 31, 1977

[54] TOILET TANK FLUSHING APPARATUS

[76] Inventor: Brooks Walker, 1280 Columbus Ave., San Francisco, Calif. 94133

[22] Filed: Apr. 1, 1976

[21] Appl. No.: 672,660

[52] U.S. Cl. ..... 4/67 R; 4/34; 4/67 A

[51] Int. Cl.[2] ..... E03D 1/34

[58] Field of Search ..... 4/67 A, 67 R, 34, 37, 4/5 TP

[56] References Cited

UNITED STATES PATENTS

| | | | |
|---|---|---|---|
| 1,074,411 | 9/1913 | Crocker | 4/67 R |
| 2,803,833 | 8/1957 | Charest | 4/67 R |
| 3,877,082 | 4/1975 | Wilhelm | 4/67 R |
| 3,943,577 | 3/1976 | Woolf et al. | 4/67 R |

*Primary Examiner*—Robert I. Smith
*Attorney, Agent, or Firm*—Gordon Wood

[57] ABSTRACT

A toilet tank flush valve which can be operted to provide a full or partial flush of the fluid contents of the tank. An auxiliary operating arm is provided so as to cooperate with the conventional valve actuating mechanism and at the same time not interfere with the operation of such mechanism. The operating arm cooperates with the conventional mechanism so that upon actuation of said arm the mechanism effects only a partial opening of the flush valve from a closed position.

6 Claims, 4 Drawing Figures

TOILET TANK FLUSHING APPARATUS

This invention relates to toilet flush valves applicable to toilets with tanks to store the flushing water.

The main object of the present invention is the provision of an auxiliary flush valve actuating mechanism which is extremely inexpensive to make and which is easily installed.

Another object of the invention is the provision of an auxiliary flush valve operating device which does not require any modification of the standard conventional flush valve operating mechanism.

Other objects and advantages of the invention will be apparent from the following specification and from the drawings.

Figure 1:
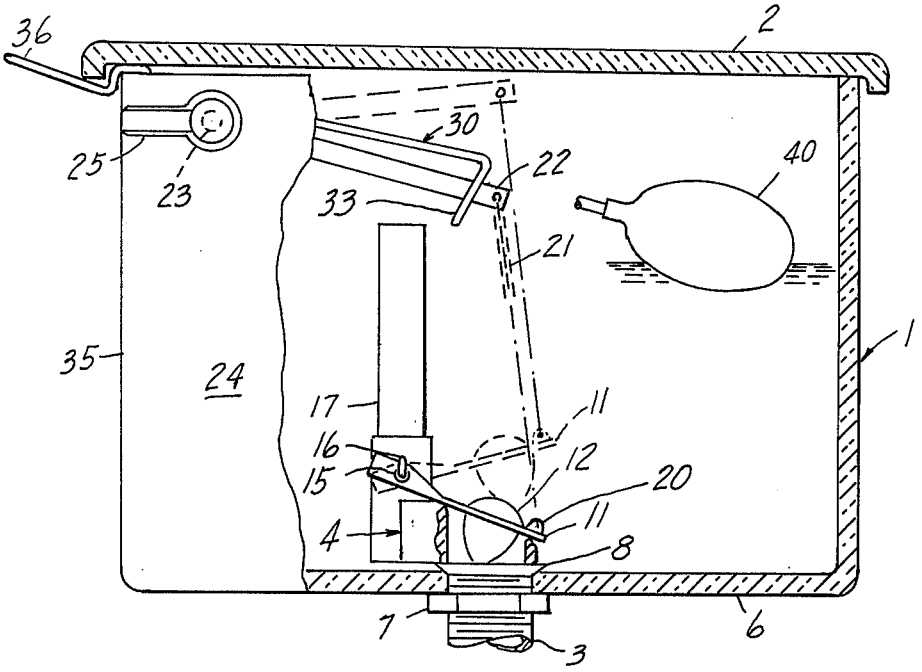
FIG. 1 is a part side elevation and part sectional view of a toilet tank showing the invention incorporated therein.

The invention is adapted to be employed with a conventional toilet tank generally designated 1 which is provided with a loosely fitting cover 2. Water is discharged to the toilet bowl (not shown) through a discharge pipe 3 which constitutes the lower end of a fitting generally designated 4. A seal 8 is interposed between the fitting 4 and lower side 6 of the tank 1 and a nut 7 is employed to tighten the fitting 4 on the bottom wall 6.

The fitting 5 is formed to provide a slantingly disposed valve seat 10 through which water is adapted to be discharged from tank 1. Cooperating with the valve seat 10 is a flat valve 11 which is formed integrally with an air chamber 12 or floatation material which causes the valve 11 to remain spaced upwardly from seat 10 when said valve is raised to its normal open position and the water level is above said valve.

The valve element 11 is formed with a bifurcated extension which is pivotally supported as at 15 on a pair of lugs 16 carried by opposite sides of a vertically extending overflow tube 17 which may be formed integrally with the fitting 4.

Valve 11 is provided with a lug 20 at its outer end and to which lug is connected a flexible tension element such as chain 21. This chain 21 is in turn connected at its upper end to the free end of a lever or link 22 which comprises part of the conventional operating mechanism. The lever 22 is secured at its opposite end to a pin 23 which is swingably supported relative to the outer wall 24 of tank 1 and which is provided with a manually actuatable handle 25 by which the flushing mechanism is operated. The rotation of handle 25 is limited by its bearing support in the tank in a conventional manner.

In operation of the normal mechanism and as best seen in FIG. 1, the handle 25 is moved downwardly to swing the lever 22 upwardly to the dotted line position of FIG. 1 thereby swinging valve 11 upwardly to the dotted line position indicated to permit rapid or full discharge of the water in tank 1 past the valve seat assembly. It will be noted from FIG. 1 that the upper position of valve 11 is sufficiently far away from the valve seat 10 so that the bouyancy of float 12 tends to hold the valve 11 in the upper open position even after the handle 25 has been released after engaging the usual stop provided in the bearing for pin 23 mounted on the tank's side.

Figure 2:
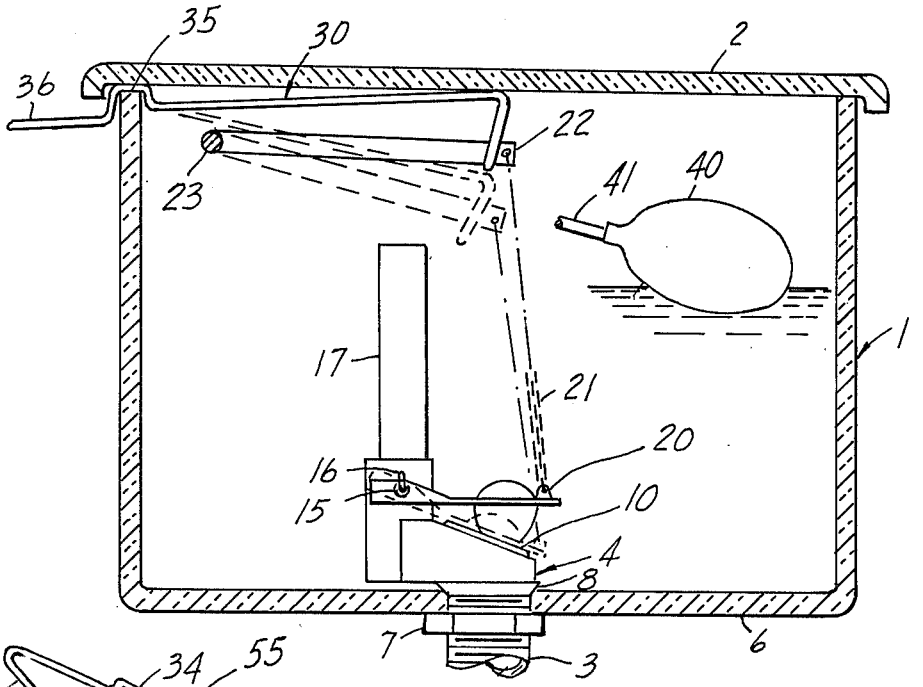
FIG. 2 is a sectional view of the tank showing the operation of the auxiliary flushing arm.

The preferred form of the present invention comprises an elongated arm generally designated 30 (FIG. 3) which is adapted to be interposed between the top of toilet tank 1 and its cover 2 as seen in FIGS. 1 and 2. This arm may readily be formed from wire to include a pair of elongated side pieces 31, 32 which are formed at one end to provide a depending U-shaped portion 33. Intermediate the ends of side portions 31, 32 the same are provided with offset portions 34 formed so as to fit over the top edge of side 35 of the toilet tank and at the same time permit the cover 2 to be installed in the normal manner. At the end of arm 30 opposite the U-shaped portion 33 the side pieces are joined to provide a manually actuatable portion 36.

As seen in FIGS. 1 and 2 the U-shaped portion 33 of arm 30 may be placed with relation to the lever 22 so as to provide no interference with the latter when the flushing mechanism which includes lever 22 is operated in the normal manner. However, when it is desired to achieve a partial flush of the tank 1 the outer end 36 of arm 30 is pushed downwardly so as to cause the inner end to move lever 22 to the full line position shown in FIG. 2 and in which position the valve 11 is only partially open. To prevent the valve 11 from opening further from its partially opened position, the arm 30 is formed so as to engage the underside of cover 2 which thus acts as a stop. As seen in FIG. 1 the peripheral portion of the cover acts as a stop to hold the arm 30 in its lower inoperative position. From FIG. 2 it will be apparent that since the float 12 of valve 11 remains closely adjacent the valve seat 10 the discharging water from the tank tends to pull the float 12 and valve 11 downwardly thereby preventing valve 11 from being raised to its normal open position as shown in dotted lines in FIG. 1. The result of this is that by actuating arm 30 only a partial flushing of the tank is achieved and in fact the particular amount of water desired to be discharged from tank 1 will depend upon the length of time the outer end 36 of arm 30 remains depressed.

In FIG. 2 the usual toilet tank float 40 is indicated which is connected by means of an arm 41 to a valve which controls the input of water to the tank. Said valve is not shown in the drawings since the same is conventional and its operation has no bearing on the present invention.

If desired, the outer end 36 of arm 30 may be provided with a cover (not shown) of rubber or the like to make the same more readily actuatable and to enhance the appearance.

Figure 3:
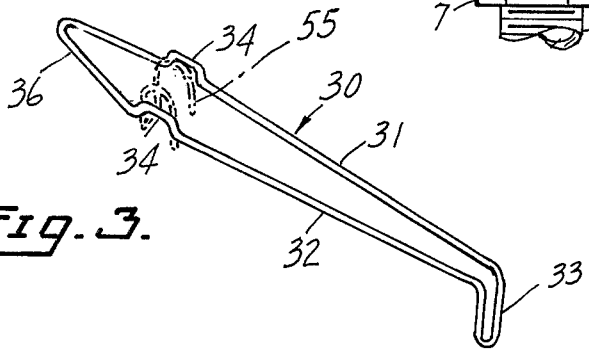
FIG. 3 is a perspective of the auxiliary actuating arm of the invention.

Also a spacer 55 formed of wire and indicated in dot-dash lines in FIG. 3 may be inserted between the top of the tank and the cover and interposed between portions 34 of arm 30 to permanently space the cover upwardly from the tank top and thus facilitate free actuation of arm 30. Such spacer 55 also prevents shifting of arm 30 along the length of the tank top edge.

Figure 4:
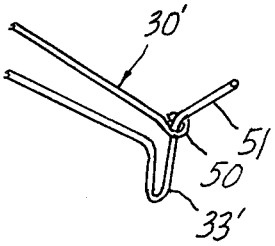
FIG. 4 is a fragmentary perspective of the inner end of arm 30 showing a modified form.

The arm 30 may also be made more readily adjustable by forming its inner end as shown in FIG. 4. In this case side 31 is formed with an eye 50 through which is received the upper end 51 of one leg of the U-shaped portion 33'. By bending the end 51 to suit the position of the underside of cover 2 the free end of the portion 51 may be made to engage the underside of cover 2 and thus provide an adjustable stop to control the upward movement of arm 30'.

I claim:

1. In a toilet tank having a flush valve, a mechanism for shifting said valve, said mechanism comprising a lever which is connected with said valve and movable from a lower position with said valve closed to an upper position for opening said valve, the improvement that comprises:

a manually actuatable arm in addition to said mechanism and having an outer end positioned outwardly of said tank and an opposite inner end within said tank in a position to engage said actuator to move the latter upwardly to open said valve, and stop means for limiting upward movement of said arm to a position at which said actuator is intermediate said upper and lower positions.

2. The structure of claim 1 wherein said tank is provided with a cover, said arm being interposed between and in engagement with the top of the tank and said cover.

3. The structure of claim 1 wherein the top of the tank constitutes a pivot for supporting said arm intermediate its ends.

4. The structure of claim 1 wherein said lever is adapted to move upwardly independently of said arm.

5. The structure of claim 1 wherein the inner end of said arm is adjustable to engage said stop means in different positions.

6. The structure of claim 1 wherein said stop means is the cover of said tank.

* * * * *